US006911951B2

(12) United States Patent
Dotto et al.

(10) Patent No.: US 6,911,951 B2
(45) Date of Patent: Jun. 28, 2005

(54) ULTRA-WIDEBAND ANTENNAS

(75) Inventors: Kim V. Dotto, Vancouver (CA); Mordechay Yedlin, Vancouver (CA)

(73) Assignee: The University of British Columbia, Vancouver (CA)

( * ) Notice: Subject to any disclaimer, the term of this patent is extended or adjusted under 35 U.S.C. 154(b) by 46 days.

(21) Appl. No.: 10/475,979

(22) PCT Filed: Apr. 24, 2002

(86) PCT No.: PCT/CA02/00589

§ 371 (c)(1),
(2), (4) Date: Oct. 27, 2003

(87) PCT Pub. No.: WO02/089253

PCT Pub. Date: Nov. 7, 2002

(65) Prior Publication Data

US 2004/0150579 A1 Aug. 5, 2004

Related U.S. Application Data

(60) Provisional application No. 60/286,367, filed on Apr. 26, 2001.

(51) Int. Cl.[7] ..... H01Q 13/10

(52) U.S. Cl. ..... 343/767; 343/795; 343/846

(58) Field of Search ..... 343/700 MS, 767, 343/770, 795, 846

(56) References Cited

U.S. PATENT DOCUMENTS

| | | | | | |
|---|---|---|---|---|---|
| 4,782,346 | A | * | 11/1988 | Sharma | 343/795 |
| 5,036,335 | A | * | 7/1991 | Jairam | 343/767 |
| 5,428,364 | A | * | 6/1995 | Lee et al. | 343/767 |
| 5,949,382 | A | * | 9/1999 | Quan | 343/767 |
| 6,043,785 | A | * | 3/2000 | Marino | 343/767 |
| H001877 | H | * | 10/2000 | Van Etten et al. | 342/188 |
| 6,191,750 | B1 | * | 2/2001 | Bonebright | 343/767 |

* cited by examiner

*Primary Examiner*—Tho Phan
(74) *Attorney, Agent, or Firm*—Oyen Wiggs Green & Mutala LLP

(57) ABSTRACT

An antipodal antenna has an active member arranged between two diverging ground elements. The active member and ground elements are shaped to provide a tapered slot. The ground elements may be planar or may be curved outwardly. In some embodiments the ground elements follow semi-parabolic conical sections. The active and ground elements may be separated by air.

30 Claims, 10 Drawing Sheets

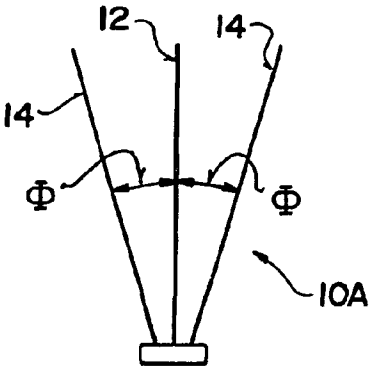
FIG. 2A
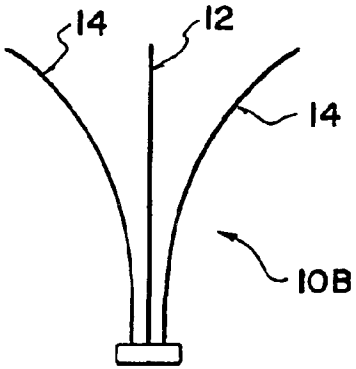
FIG. 2B
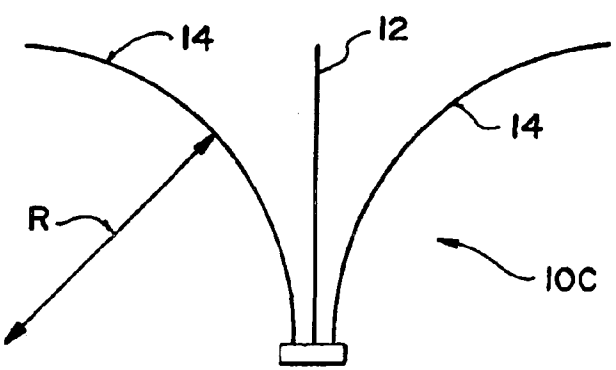
FIG. 2C
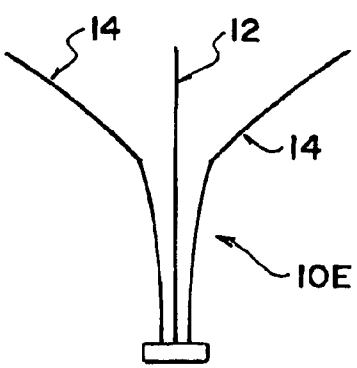
FIG. 2D
FIG. 2E
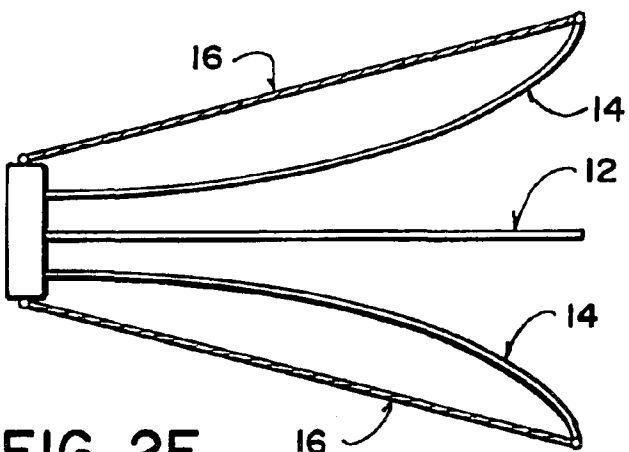
FIG. 2F

ULTRA-WIDEBAND ANTENNAS

CROSS REFERENCE TO RELATED APPLICATIONS

This application claims the benefit of the filing date of U.S. patent application No. 60/286,367 filed on 26 Apr. 2001.

TECHNICAL FIELD

This invention relates to antennas for transmitting and/or receiving electromagnetic radiation.

BACKGROUND

There are various applications for which wide band transmitting and receiving antennas are required. These include applications in fields such as medical imaging, radar, radio frequency crystallography and telecommunications.

One type of antenna which is used in such applications are microstrip antennas. A typical microstrip antenna is fabricated by forming a shaped metallized layer on a planar circuit board substrate. Another metallized layer on the substrate serves as a ground plane. U.S. Pat. No. 5,036,335 describes an example of a microstrip antenna.

A balanced stripline antenna is similar to a microstrip antenna except that it has a pair of ground planes, one on each side of the active element. Guillanton et al. *A new design tapered slot antenna for ultra-wideband applications* Microwave and Optical Technology Letters v. 19, No. 4, November 1998 discloses a balanced antipodal Vivaldi antenna made using stripline technology.

Microstrip and stripline antennas suffer from the disadvantage that the dielectric substrate materials on which the metallized layers are supported adversely affect the radiation characteristics of the antennas at certain frequencies.

There is a need for antennas capable of transmitting, receiving and/or receiving and transmitting over a wide frequency range.

SUMMARY OF THE INVENTION

This invention provides antennas for the transmission and/or reception of electromagnetic radiation. A first aspect of the invention provides an antipodal antenna comprising an active element located between a pair of matched, symmetrically diverging, ground elements. The active and ground elements may comprise sheets of electrically conductive material. In some embodiments, inside edge portions of the active element and ground elements at distal ends of the active and ground elements diverge from one another to provide a tapered slot.

In various embodiments of the invention the inside edge portions of the active element and ground elements follow convex exponential curves. The active element may comprise a broad distal portion supported at an end of a thinner member. The ground elements may also each comprise a broad distal portion supported at an end of a thinner member. Where the active and ground elements comprise broad distal portions the broad distal portion of the active element may be entirely on a first side of the centerline (i.e. on a first side of an imaginary transversely-extending plane which includes the centerline) and the broad distal portions of the ground elements may be entirely on a second side of the centerline (i.e. on a second side of the transversely-extending plane).

In various specific embodiments, the ground elements each follow: a semi-cubical parabolic curve; an arc; an exponential curve; a line (e.g. the ground elements are planar); or an elliptical curve. In some embodiments, the ground elements comprise resiliently flexible sheets and the antenna comprises a member holding each of the resiliently flexible sheets in a curved configuration.

Further features of the invention and specific embodiments of the invention are described below.

BRIEF DESCRIPTION OF THE DRAWINGS

In drawings which illustrate non-limiting embodiments of the invention:

FIGS. 2A, 2B, 2C, 2D and 2E are top plan view of antennas according to embodiments of the invention in which the ground elements have different curvatures;

FIGS. 2F and 2G are top plan view of antennas according to embodiments of the invention in which the ground elements are held in curved configurations;

DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

Figure 1:
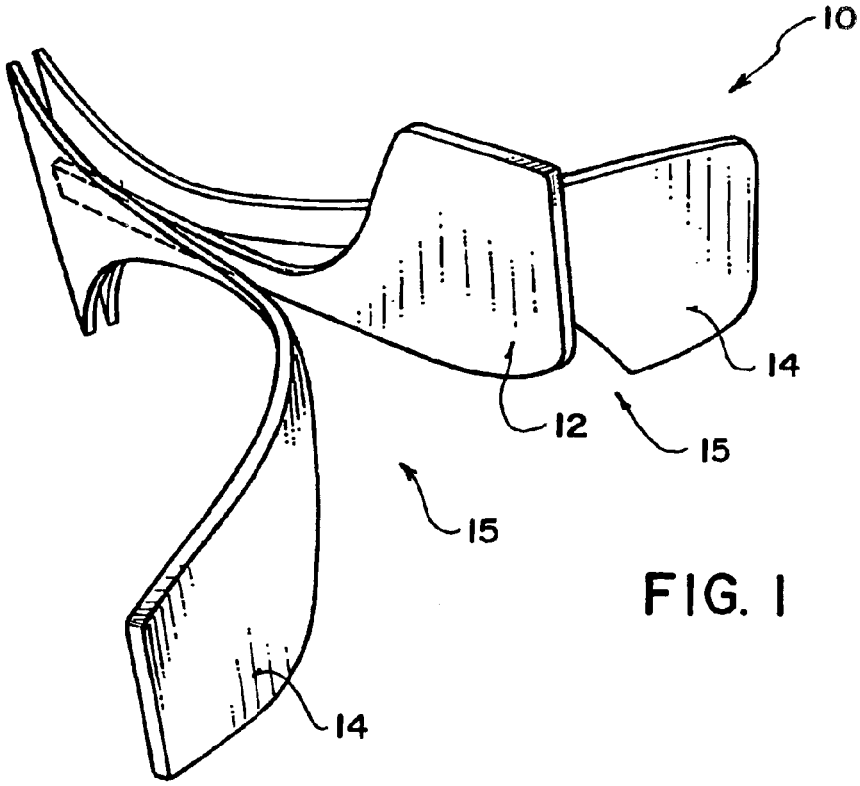
FIG. 1 is a perspective view of an antenna according to one embodiment of the invention.

FIG. 1 shows an antenna 10 according to one embodiment of the invention. Antenna 10 has an active element 12 located symmetrically between a pair of ground elements 14. Each of elements 12 and 14 may be formed from a sheet of an electrically conductive material. The electrically conductive material may be a metal. For example, elements 12 and 14 may be formed of copper sheets. Active element 12 is electrically isolated from ground elements 14.

Active element 12 is separated on either side from ground elements 14 by an air gap 15. Ground elements 14 are not parallel to active element 12 but diverge from one another. Ground elements 14 are symmetrical with respect to active element 12. In a currently preferred embodiment of the invention, each of ground elements 14 follows a semi-cubical parabolic curve. A semi-cubical parabolic curve is a curve on which points (r, θ) satisfy the equation:

$$r=\alpha \tan^2 \theta \sec\theta \quad (1)$$

Figure 2:
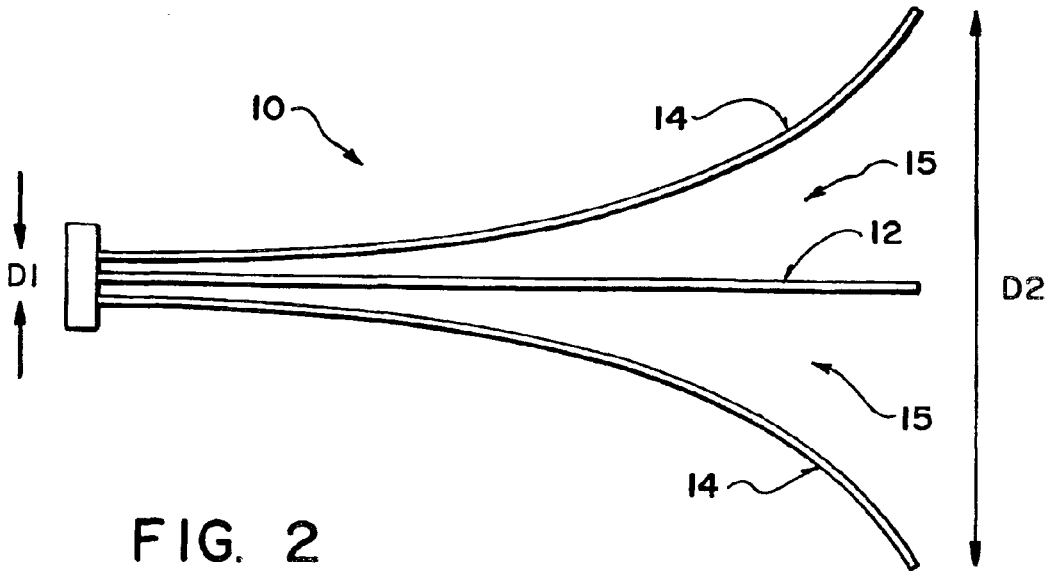
FIG. 2 is a top view of the antenna of FIG. 1.

In other embodiments of the invention, ground elements 14 may diverge in different manners. For example:

FIG. 2A shows a top view of an antenna 10A wherein ground elements 14 are straight and diverge with an angle Φ.

FIG. 2B shows a top view of an antenna 10B wherein ground elements 14 follow an exponential profile given by the equation:

$$y=e^{f(x)} \tag{2}$$

in the example of FIG. 2B, f(x)=x;

FIG. 2C shows a top view of an antenna 10C wherein ground elements 14 follow arcs;

FIG. 2D shows a top view of an antenna 10D wherein ground elements 14 follow an elliptical profile given by the equation:

$$\frac{x^2}{a^2}-\frac{y^2}{b^2}=c^2 \tag{3}$$

FIG. 2E shows a top view of an antenna 10E wherein ground elements 14 follow irregular profiles.

The curved shapes of ground elements 14 may be provided in various ways including:

making elements 14 from a flexible material, such as a metallic sheet, which can be bent to have the desired curve;

casting or molding elements 14 in the desired shapes from a castable or moldable material; or, providing elements 14 made from a resiliently flexible material and holding elements 14 in a flexed configuration.

Figure 2G:
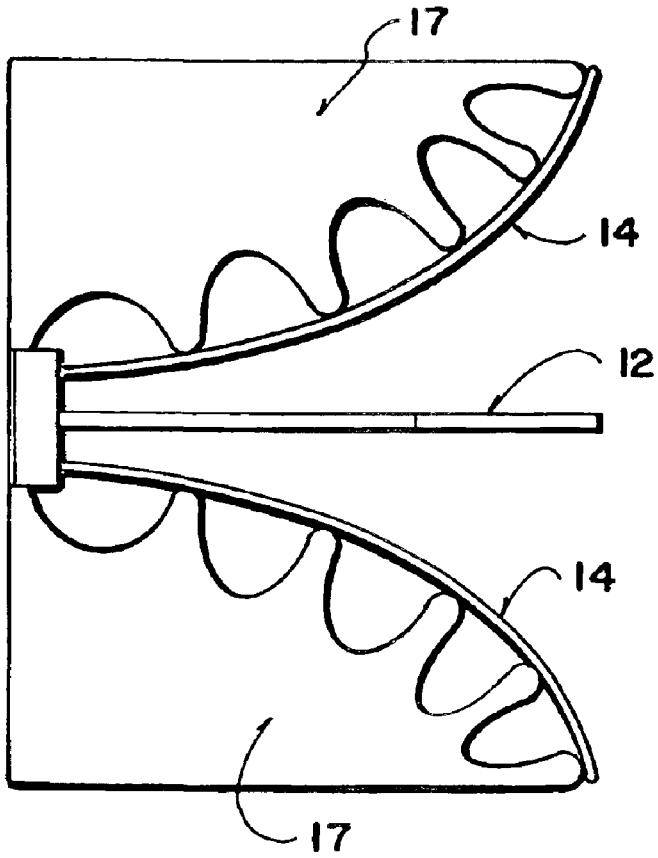

FIG. 2F shows a top view of an antenna 10F wherein ground elements 14 are made from a resiliently flexible material and are held in a curved configuration by non-conductive strings 16. In the embodiment of FIG. 2F the curve of ground elements 14 is determined by the length of strings 16 and the bending characteristics of ground elements 14. FIG. 2G shows a top view of an antenna 10G wherein ground elements 14 are made from a flexible material and are shaped by forms 17. Forms 17 may contact ground elements 14 only at a few points to minimize the amount of dielectric material near ground elements 14.

Figure 3:
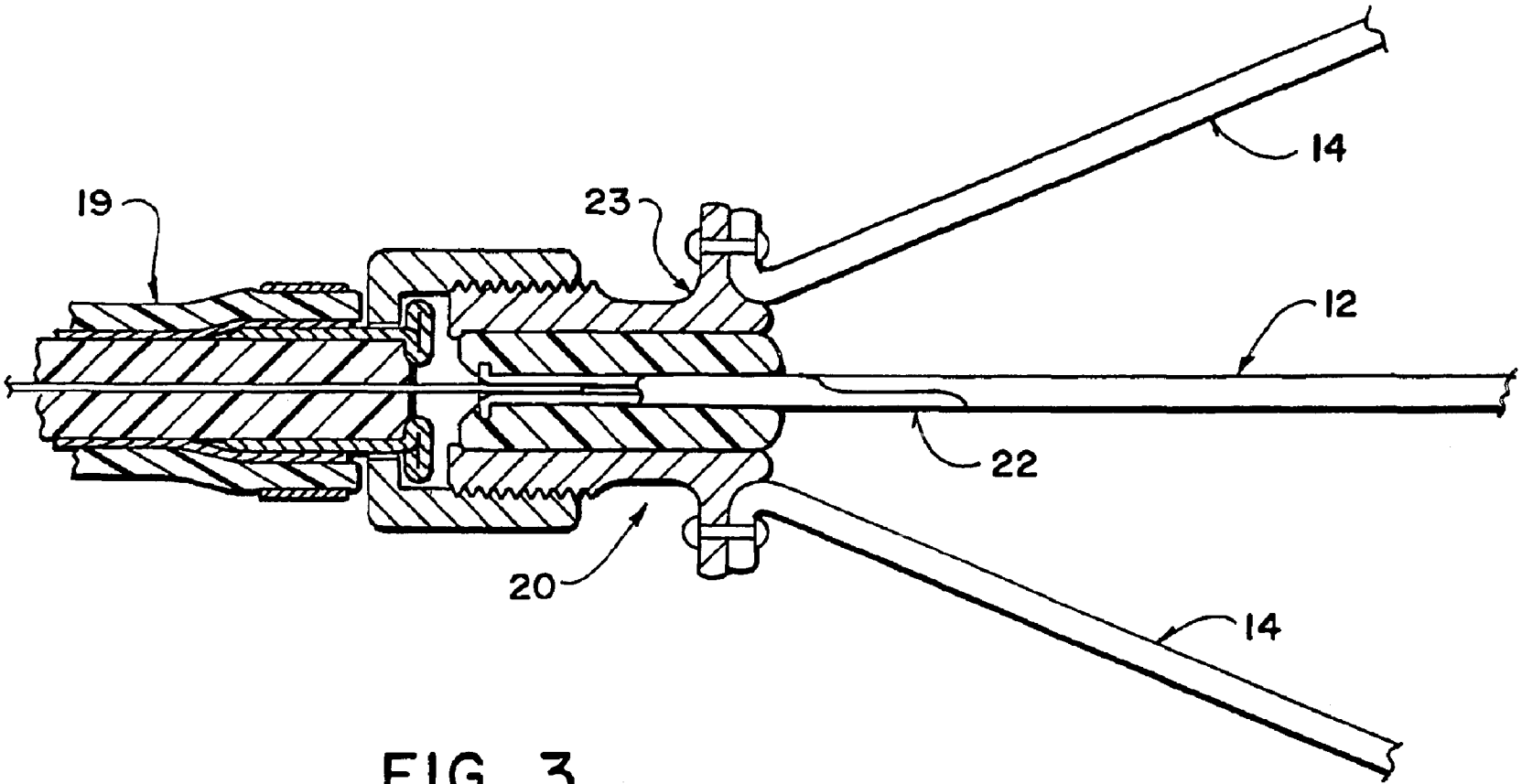
FIG. 3 is a detailed view of an antenna according to an embodiment of the invention in which the antenna incorporates a coaxial cable connector.

As shown in FIG. 3, antenna 10 may be driven by a signal supplied through a coaxial cable 19. Antenna 10 may incorporate a coaxial cable connector 20 having a center conductor 22. Active element 12 may be affixed directly to center conductor 22. Ground elements 14 may be attached to the ground conductor 23 of cable connector 20. In alternative embodiments of the invention, active element 12 and ground elements 14 may be attached to a base comprising a printed circuit board. The elements of antenna 10 may be driven by signals provided by way of conductive elements of the printed circuit board.

Figure 4:
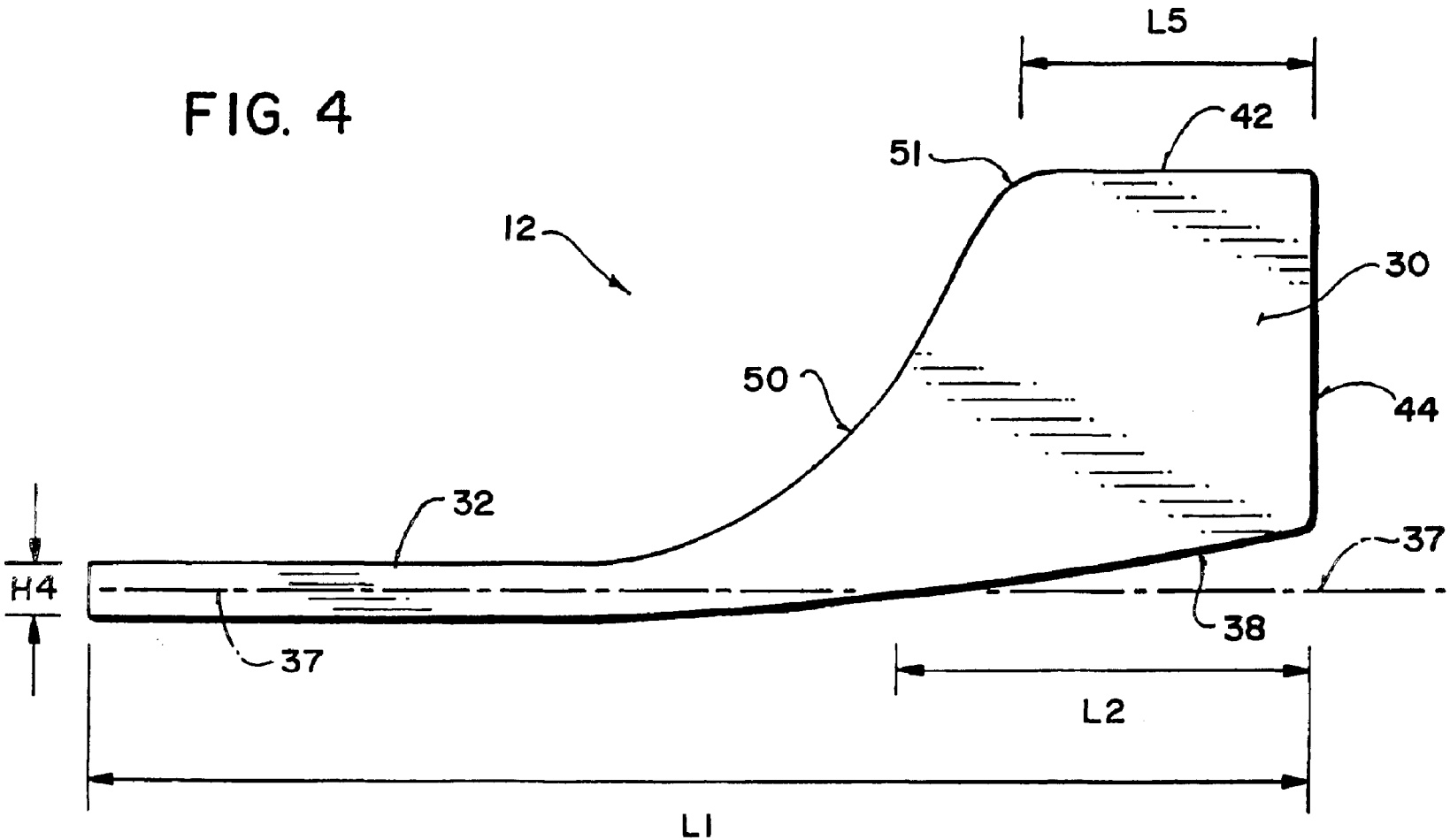
FIG. 4 is a side elevational view of the active element of the antenna of FIG. 1.
Figure 5:
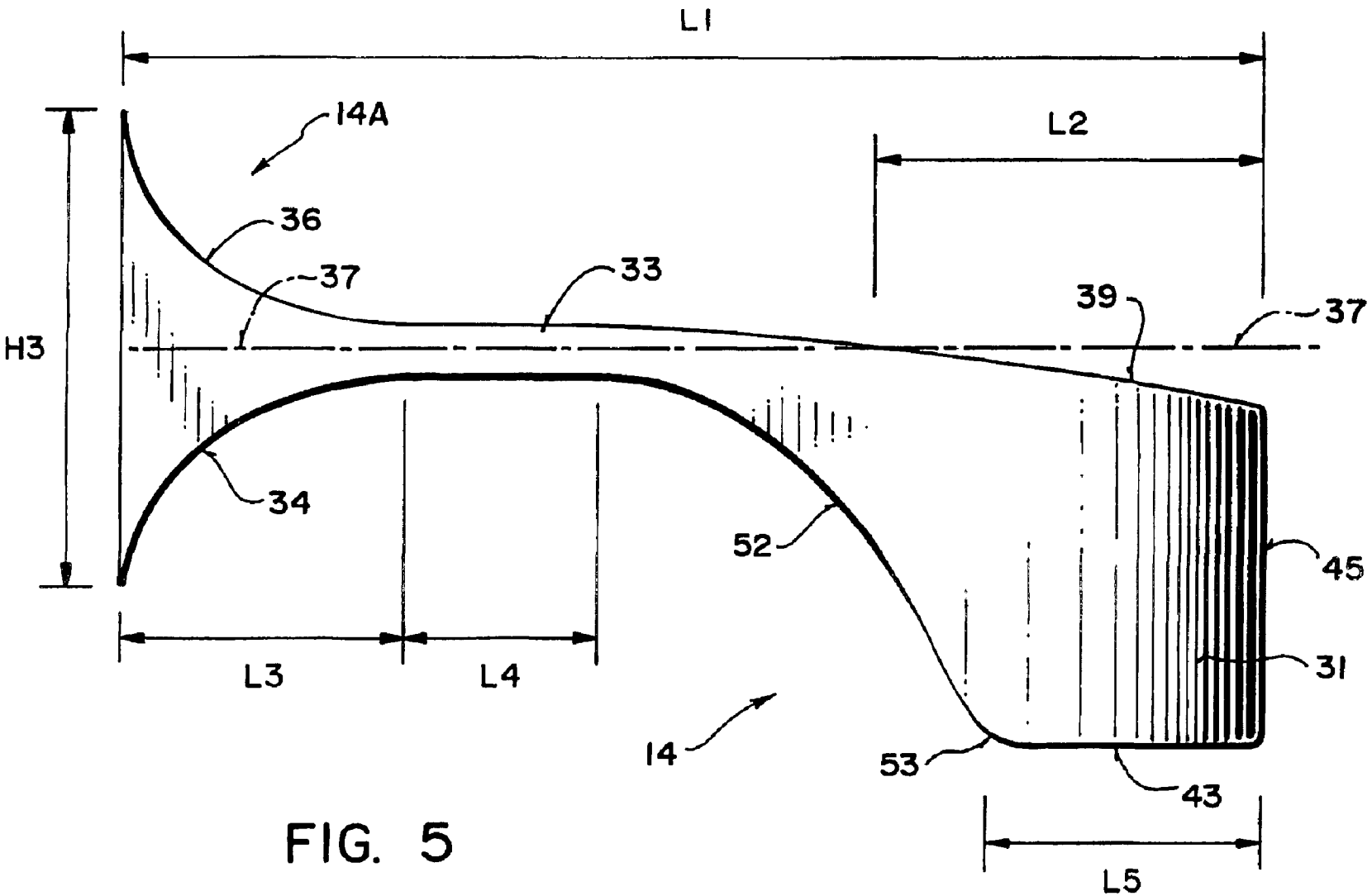
FIG. 5 is a side elevational view of a ground element of the antenna of FIG. 1.
Figure 6:
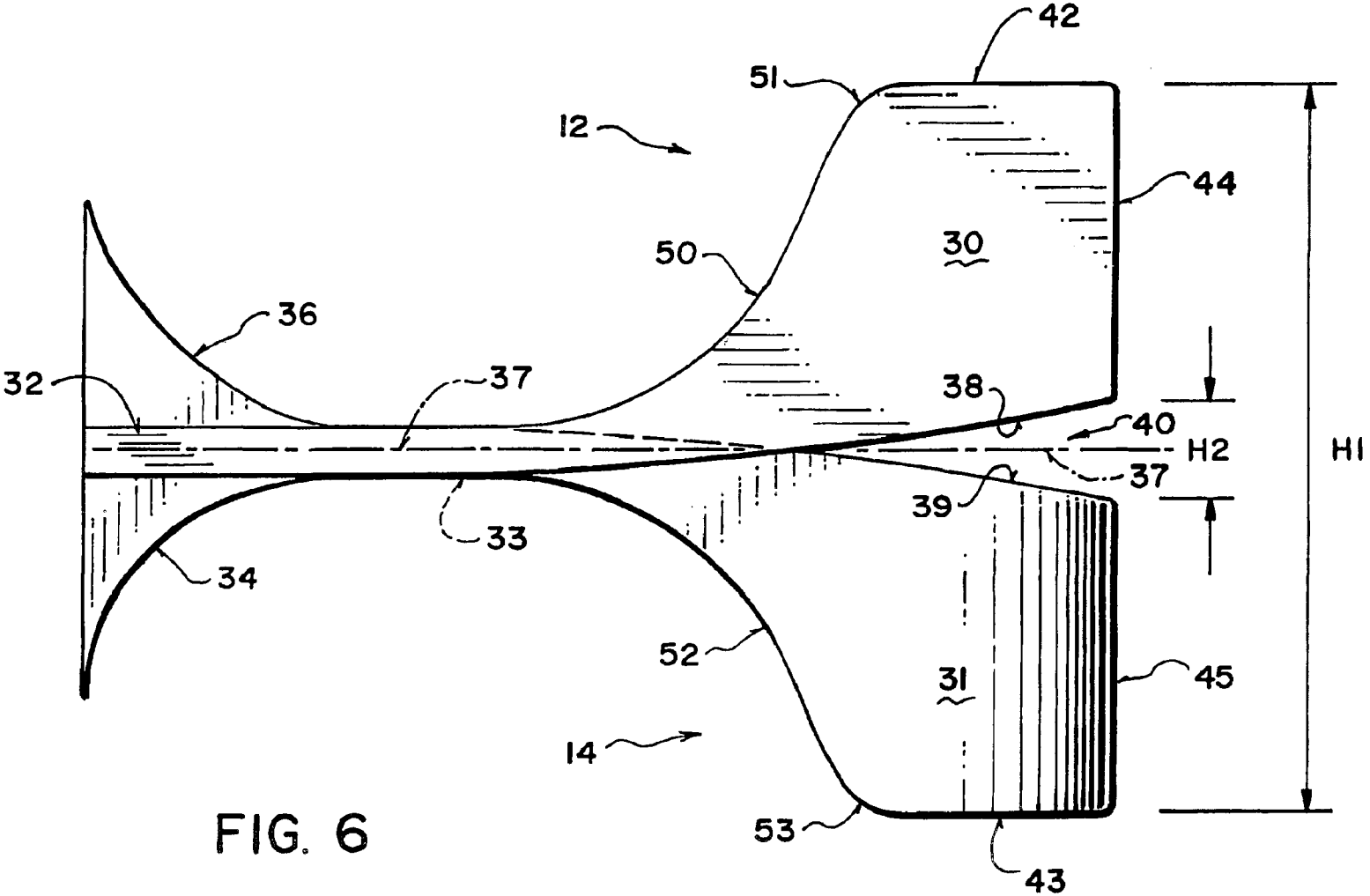
FIG. 6 is a side elevational view of the antenna of FIG. 1 with one ground element removed.

As shown in FIGS. 4, 5 and 6 active element 12 comprises a broad distal portion 30 supported at the end of a thinner member 32. Distal portion 30 has curved corners. Ground elements 14 also each comprise broad distal portions 31 supported at the ends of thinner members 33. Members 32 and 33 may be equal in width to one another and may extend along a centerline 37 of antenna 10 when viewed from the side. As shown in FIG. 2D, members 32 and 33 may be substantially parallel to one another over most of their lengths as viewed from above.

Medial ends 14A of ground elements 14 are flared. The edges of ground elements 14 follow suitable curves. For example, in portions 34 and 36 the edges of ground element 14 may follow elliptical or exponential curves. In one embodiment, portions 34 on edge of ground elements 14 follow elliptical curves and portions 36 follow exponential curves. The medial end of active element 12 is preferably not flared.

As shown best in FIG. 6, distal portion 30 of active element 12 has an inside edge portion 38 which, together with an inside edge portion 39 on ground elements 14 forms a tapered slot 40 when antenna 10 is viewed from the side. Inside edge portion 38 of active element 12 and inside edge portions 39 of ground elements 14 may diverge symmetrically from centerline 37. Inside edge portion 38 may follow an exponential curve. Inside edge portions 39 may follow exponential curves.

Distal portion 30 of active element 12 may have flats 42 and 44 on its outer and end edges. Distal portions 31 of ground elements 14 may also have flats 43 and 45 on their outer and end edges.

Antennas according to the invention may have particular application in receiving and transmitting signals having frequencies in the range of 20 MHz to 100 GHz.

Antennas according to some embodiments of the invention are characterized by a return loss of less than −3 dB and a deviation about the mean return loss of less than 10 dB over a bandwidth of 5 GHz.

EXAMPLE

An antenna according to a prototype embodiment of the invention, has the dimensions:

L1=10 cm;
L2=3.3 cm;
L4=1.7 cm;
L5=2.4 cm;
D1=00.5 cm;
D2=9.0 cm;
H1=7.4 cm;
H2=2 cm;
H3=5.0 cm; and,
H4=0.5 cm.

The active and ground elements of the prototype antenna were fabricated from copper sheet having a thickness of approximately 0.675 mm.

In the prototype antenna, edges of active element 12 followed the following curves:

in portion 50—concave circular arc;

a in portion 51—convex circular arc; and, in portion 38—convex exponential curve.

In the prototype antenna, edges of ground elements 14 followed the following curves:

in portion 34—concave elliptical curve;

in portion 36—concave exponential curve;

in portion 39—convex exponential curve;

in portion 52—concave circular arc; and, in portion 53—convex circular arc.

The ground elements of the prototype antenna followed exponential curves, as shown in FIG. 2B.

Figure 7:
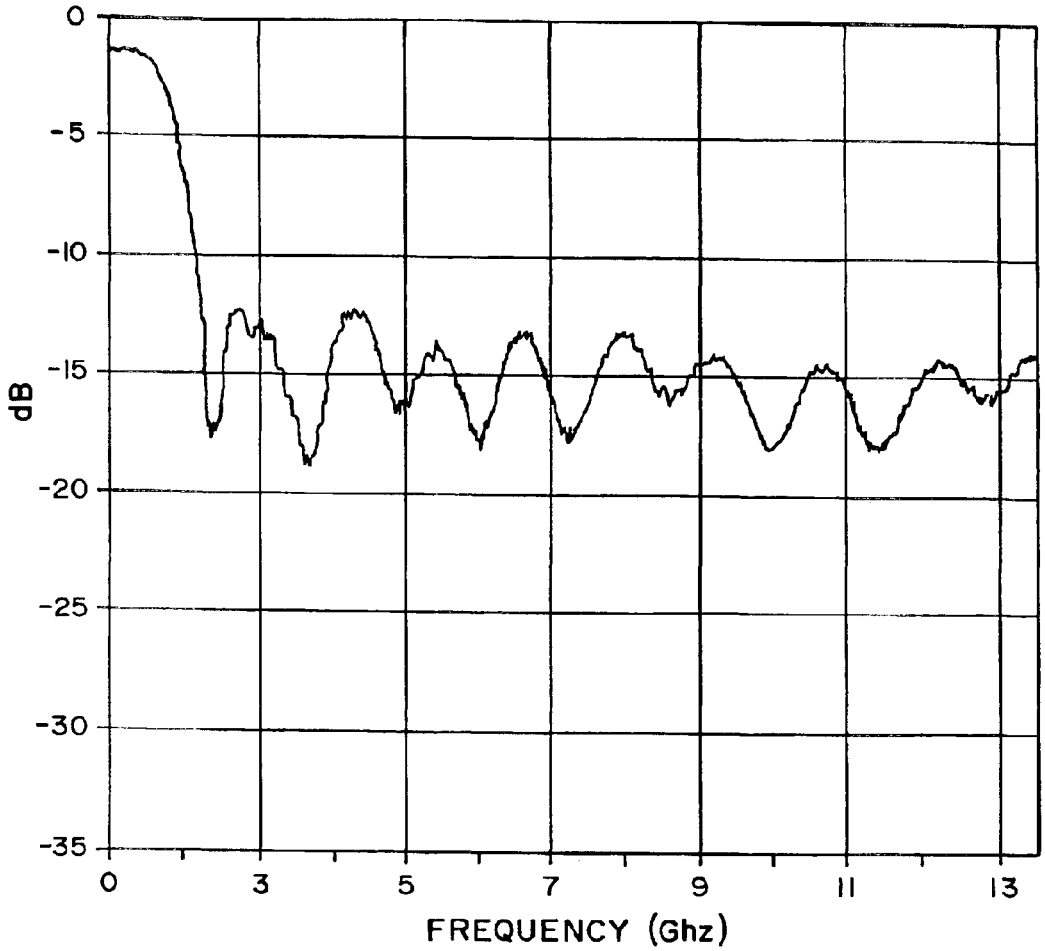
FIG. 7 shows a return loss curve for a prototype antenna.
Figure 8:
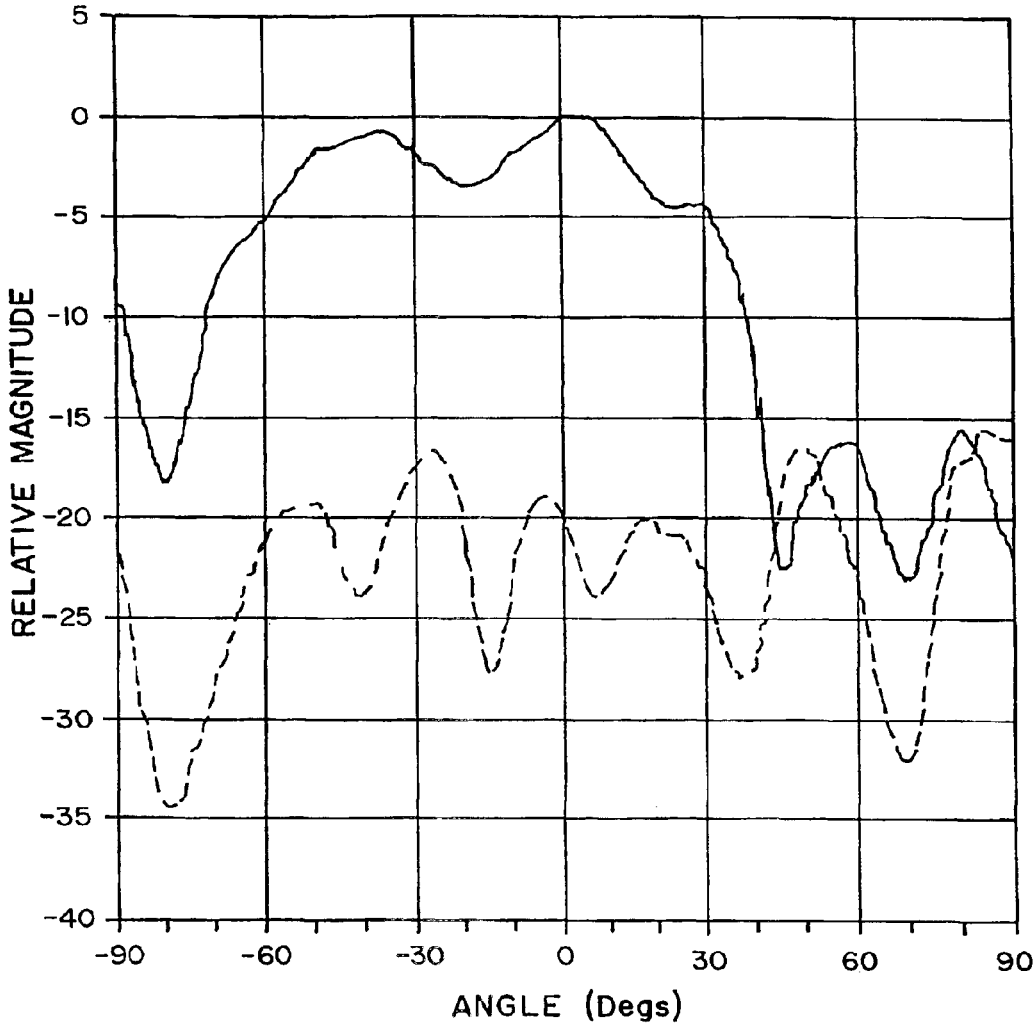
FIGS. 8 and 9 show E and H plane radiation patterns for the prototype antenna at 9 GHz.
Figure 9:
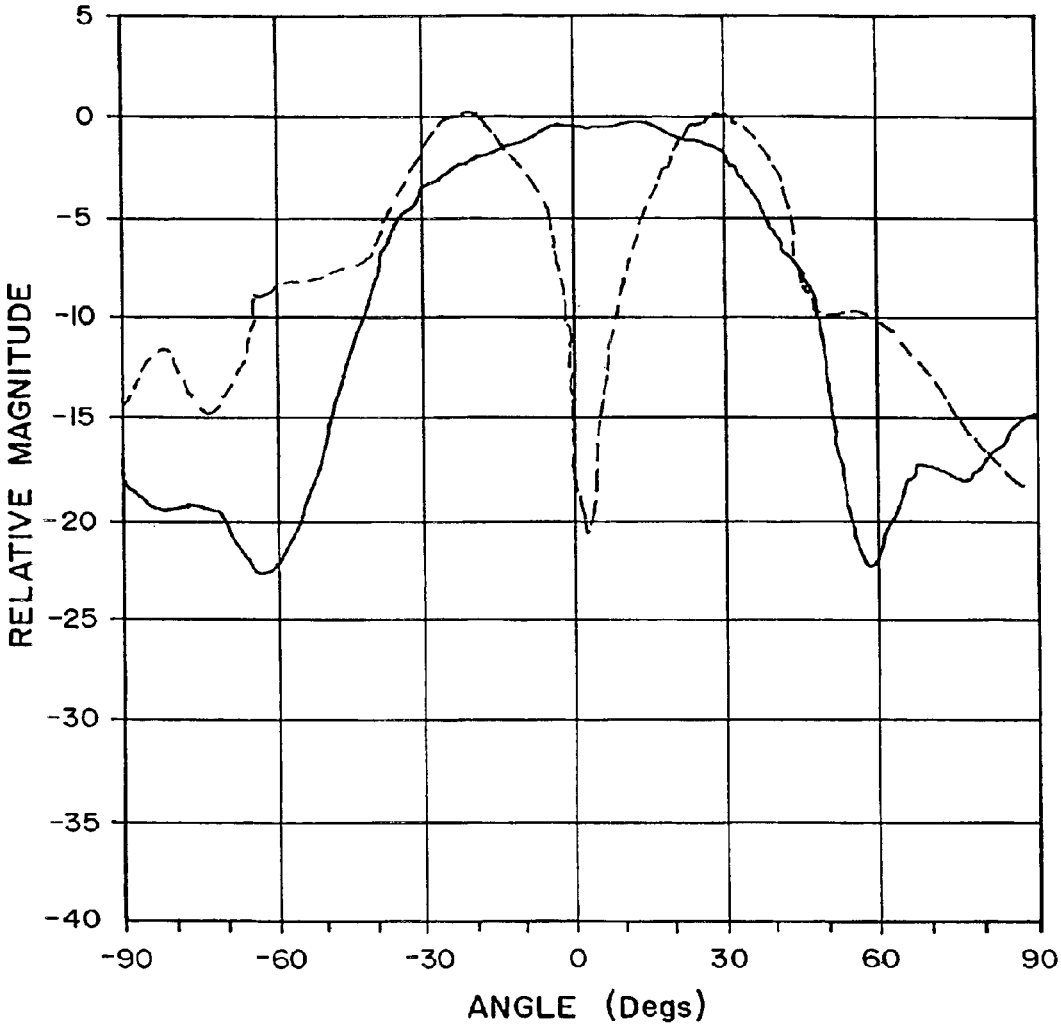

The prototype antenna demonstrated a 10 dB bandwidth of 2.2 GHz to 13.5 GHz. FIG. 7 shows a S11 return loss curve for the prototype antenna. FIGS. 8 and 9 show respectively E and H plane radiation patterns for the prototype antenna at 9 GHz. In FIGS. 8 and 9, co-polarization is indicated by solid curves and cross polarization is indicated by dashed curves. The level of cross-polarization in the E plane is below 18 dB at 0°. The level of cross-polarization in the H plane is approximately −21 dB at 0°. The gain at 9 GHz is 6 dB.

As will be apparent to those skilled in the art in the light of the foregoing disclosure, many alterations and modifications are possible in the practice of this invention without departing from the spirit or scope thereof. For example:

Active element 12 and ground elements 14 do not need to be made entirely of the same conductive material. These elements could comprise a core of some other material coated or plated with an electrically conductive material.

The dielectric surrounding the elements of antenna 10 may be air, a gas, a liquid, vacuum, or a solid material (solid materials include mixed-phase materials such as foams). Antenna 10 may be mounted within a suitable radome (i.e. an enclosure). The atmosphere within the enclosure may be varied to change the dielectric properties of the material surrounding antenna 10.

Additional active elements or ground elements may be added to refine the properties of an antenna 10.

The dimensions of an antenna according to the invention may be scaled for operation in different frequency ranges.

While it is generally not preferred, small dielectric spacers could be provided between the active element and the ground elements to maintain a desired shape of the ground elements by holding the ground elements away from the active element.

Accordingly, the scope of the invention is to be construed in accordance with the substance defined by the following claims.

What is claimed is:

1. An antipodal antenna comprising an active element located between a pair of matched, symmetrically diverging, ground elements.

2. The antenna of claim 1 wherein inside edge portions of the active element and ground elements at distal ends of the active and ground elements diverge from one another to provide a tapered slot.

3. The antenna of claim 2 wherein the tapered slot is symmetrical with respect to a centerline.

4. The antenna of claim 3 wherein the active element comprises a broad distal portion supported at an end of a thinner member.

5. The antenna of claim 4 wherein the ground elements each comprise a broad distal portion supported at an end of a thinner member.

6. The antenna of claim 4 wherein the broad distal portion of the active element is entirely on a first side of the centerline.

7. The antenna of claim 6 wherein the broad distal portions of the ground elements are entirely on a second side of the centerline.

8. The antenna of claim 2 wherein the inside edge portions of the active element and ground elements follow convex exponential curves.

9. The antenna of claim 1 wherein the active element and ground elements comprise electrically conducting members having widths and thicknesses wherein the thickness of each element is substantially smaller than its width.

10. The antenna of claim 1 wherein the active element and ground elements each comprise a sheet of material.

11. The antenna of claim 10 wherein the ground elements are curved and all axes of curvature of the ground elements are parallel to a plane of the active element.

12. The antenna of claim 1 wherein the active element is substantially planar.

13. The antenna of claim 1 wherein the ground elements are curved.

14. The antenna of claim 13 wherein the ground elements each follow a semi-cubical parabolic curve.

15. The antenna of claim 13 wherein the ground elements each follow an arc.

16. The antenna of claim 13 wherein the ground elements each follow an exponential curve.

17. The antenna of claim 13 wherein the ground elements each follow an elliptical curve.

18. The antenna of claim 1 wherein the ground elements are each planar.

19. The antenna of claim 1 wherein the active and ground elements are surrounded by air.

20. The antenna of claim 1 wherein the active and ground elements are surrounded by a gas other than air.

21. The antenna of claim 1 wherein the active and ground elements are surrounded by a liquid having dielectric properties different from air.

22. The antenna of claim 1 wherein the active and ground elements are in a vacuum.

23. The antenna of claim 1 wherein the active and ground elements are embedded in a solid dielectric material.

24. The antenna of claim 1 wherein the ground elements comprise resiliently flexible sheets and the antenna comprises a member holding each of the resiliently flexible sheets in a curved configuration.

25. The antenna of claim 1 wherein the ground elements each comprise a flexible sheet, the antenna comprises a curved form corresponding to each of the ground elements and each of the ground elements is held to follow the curved form.

26. The antenna of claim 25 wherein each of the curved forms makes contact with the corresponding ground element only at discrete spaced apart areas.

27. The antenna of claim 1 comprising a coaxial connector having a center conductor and a shield conductor wherein the active element is mounted directly to the center conductor and the ground elements are mounted to the shield conductor.

28. The antenna of claim 1 having a mean return loss of less than −3 dB and a deviation about the mean return loss of less than 10 dB over a bandwidth of 5 GHz.

29. The antenna of claim 1 wherein medial ends of ground elements are flared.

30. The use of an antenna as described in claim 1 for transmitting electromagnetic radiation at one or more frequencies in the range of 20 MHz to 100 GHz.

* * * * *